US005618217A

United States Patent [19]

Then et al.

[11] Patent Number: 5,618,217

[45] Date of Patent: Apr. 8, 1997

[54] METHOD FOR FABRICATION OF DISCRETE DYNODE ELECTRON MULTIPLIERS

[75] Inventors: Alan M. Then, Auburn; Scott T. Bentley, Norfolk, both of Mass.

[73] Assignee: Center for Advanced Fiberoptic Applications, Southbridge, Mass.

[21] Appl. No.: 506,611

[22] Filed: Jul. 25, 1995

[51] Int. Cl.[6] ..... H01J 43/18; H01J 9/12

[52] U.S. Cl. ..... 445/35; 445/49

[58] Field of Search ..... 445/35, 49; 313/105 CM, 313/103 CM

[56] References Cited

U.S. PATENT DOCUMENTS

| | | | |
|---|---|---|---|
| 4,099,079 | 7/1978 | Knapp | 313/103 CM |
| 4,422,005 | 12/1983 | Washington et al. | 313/105 CM |
| 4,482,836 | 11/1984 | Washington et al. | 313/104 |
| 4,626,736 | 12/1986 | Mansell | 313/105 CM |
| 4,649,314 | 3/1987 | Eschard | 313/103 CM |
| 4,825,118 | 4/1989 | Kyushima | 313/103 CM X |
| 5,378,960 | 1/1995 | Tasker et al. | 313/103 CM |

*Primary Examiner*—Kenneth J. Ramsey
*Attorney, Agent, or Firm*—Watson Cole Stevens Davis, P.L.L.C.

[57] ABSTRACT

A method for manufacturing a discrete dynode electron multiplier includes employing micromachining and thin film techniques to produce tapered apertures in an etchable substrate, bonding the substrates together and activating the internal surfaces of the etched substrate using chemical vapor deposition or oxidizing and nitriding techniques.

6 Claims, 5 Drawing Sheets

METHOD FOR FABRICATION OF DISCRETE DYNODE ELECTRON MULTIPLIERS

GOVERNMENT RIGHTS

The invention was conceived under the Advanced Technology Microchannel Plate development program awarded by the Advanced Technology Program of the National Institute of Standards and Technology. The Government retains certain rights in the invention.

BACKGROUND OF THE INVENTION

The invention relates to the manufacture of discrete dynode electron multipliers and in particular to the manufacture of such devices using micromachining techniques.

Discrete dynode electron multipliers are known. The art discloses various techniques for producing such devices. However, the art does not disclose the use of silicon micromachining techniques and thin film activation to produce integrated discrete dynode electron multipliers.

SUMMARY OF THE INVENTION

The present invention is based upon the discovery that a discrete diode electron multiplier may be fabricated using semiconductor processing techniques, and particularly, micromachining techniques combined with thin film dynode activation.

The present invention is directed to a method for constructing a completely micromachined discrete dynode electron multiplier (DDM) that is activated with a thin-film dynode surface. Although other materials may be available, the exemplary embodiment is designed to be used specifically with Silicon (Si) substrates. This takes advantage of the wide availability and low cost of Si and allows the use of semiconductor processing techniques. The use of Si also facilitates integration into further MOS processing, thus avoiding problems associated with materials compatibility. In addition, Si allows direct integration of support electronics with the electron multiplier.

In a particular embodiment, the method comprises forming an electrical isolation layer on an etchable, conductive or semi-conductive substrate, masking and patterning the isolation layer; and transferring pattern to the substrate by anisotropic dry etching of the mask and isolation layer to produce apertures therein. Thereafter, the substrate is anisotropically etched through the apertures to produce surfaces disposed partially transverse to the axis of the apertures. The pattern is thereafter removed and pairs of substrates are bonded together in confronting relation to form discrete dynode elements which are thereafter activated to become electron emissive.

DESCRIPTION OF THE INVENTION

Figure 1:
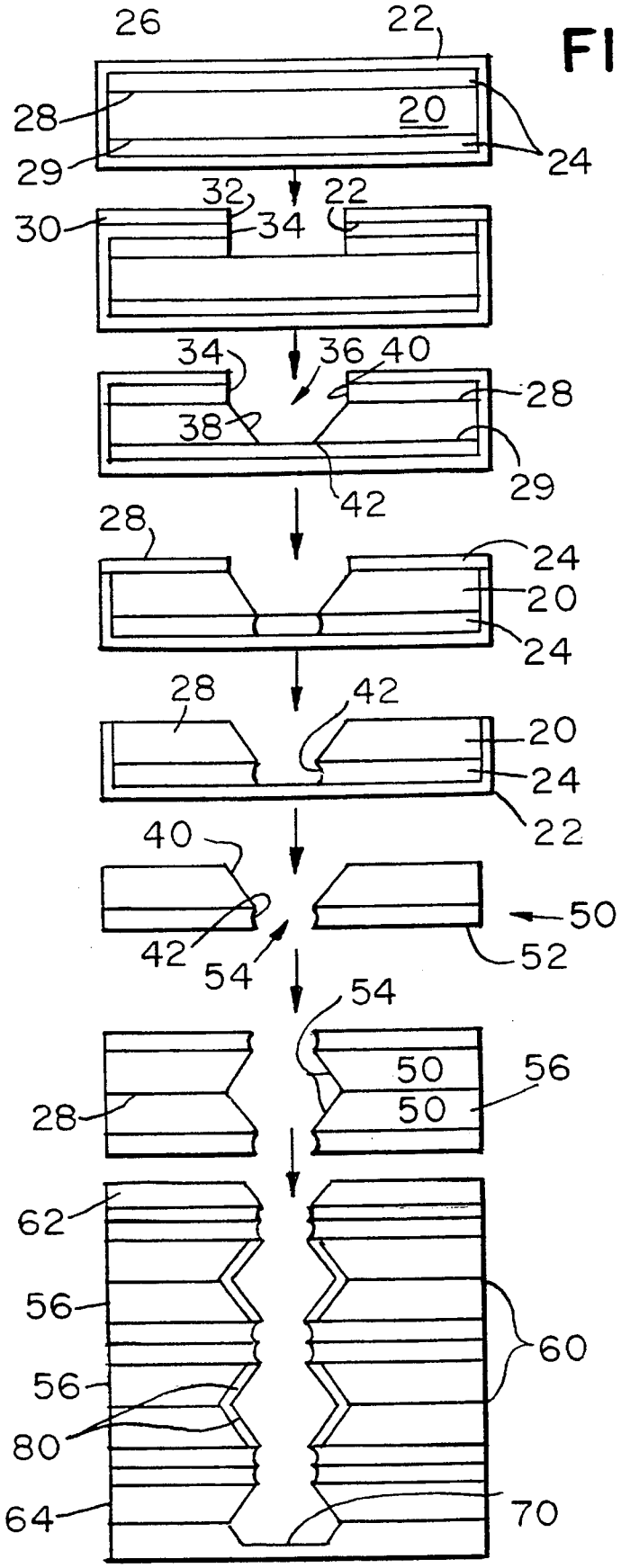
FIG. 1 illustrates the general flow diagram of a process for micromachining discrete dynode electron multipliers according to the present invention.

A general flow diagram of the process is shown in FIG. 1 depicting steps (a)–(h). The process begins at step (a) by forming a wafer 20 and generating a hard mask 22 thereon. It is preferable to have a silicon wafer 20 of the n-type doped and as conductive as possible (0.001–1.0_Ω-cm). Wafers that are p-type doped may also be useful to change the charge replenishment characteristics of the dynode structure. Suitable hard mask materials include polymers, dielectrics, metals and semiconductors. An exemplary process employs a composite structure of $SiO_2$ forming an outer isolation layer 24 produced by either direct thermal oxidation of the silicon substrate 20 or by chemical vapor deposition (CVD); and $SiO_yN_x$ forming a hard outer layer 26 produced by CVD. The hard mask 22 may employ one of these materials or it may be a composite of these materials as depicted in the process described herein. The composite hard mask 22 used in the exemplary embodiment better preserves the cleanliness and flatness of the respective top and bottom of the substrate wafer 20 for later bonding.

At step (b) the hard mask is coated with a photo-sensitive polymer or photoresist 30 and a pattern of one or more apertures 32 is generated in the photoresist 30 by optical lithography. Other lithographic methods may be employed such as electron-beam, ion-beam or x-ray lithography. However, photolithography is readily available and less expensive than other lithographic processes. Regardless of how the pattern 32 is initially generated in the photoresist 30, it is transferred as opening 34 through the hard mask 22 by reactive particle etching (RPE).

In the process sequence illustrated in FIG. 1, the pattern transferred to the hard mask 22 is a square opening 34. The size for this opening 34 may be between about 50 to 1000 μm.

Figure 2A:
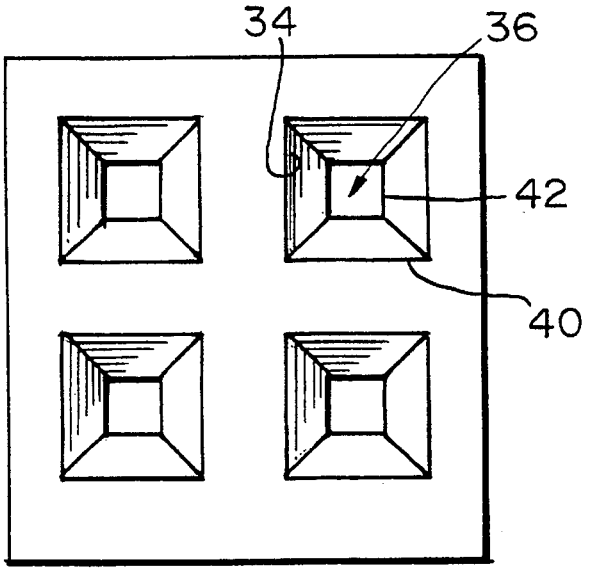
FIGS. 2A and 2B depict respective top plan and side sectional views of a square aperture in a Si wafer having the shape of a truncated pyramid.
Figure 2B:
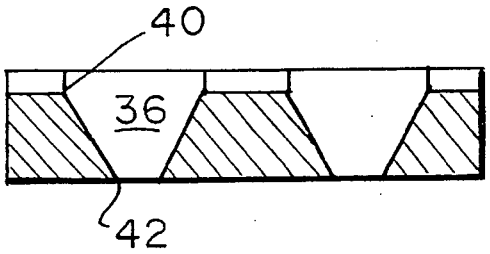
Figure 2C:
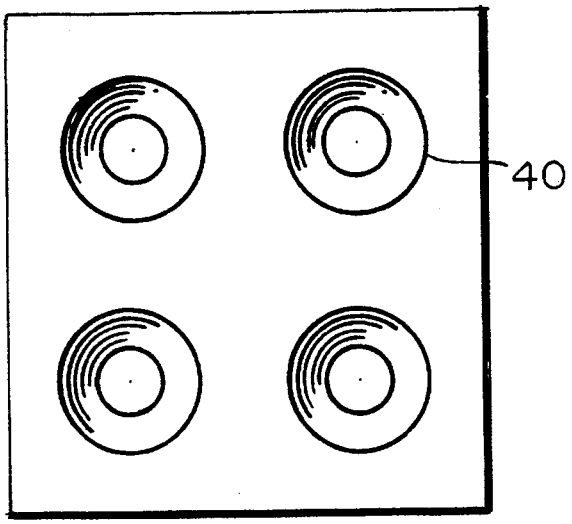
FIGS. 2C and 2D depict respective top plan side sectional views of a circular aperture in a Si wafer in the form of a truncated hemisphere.
Figure 2D:
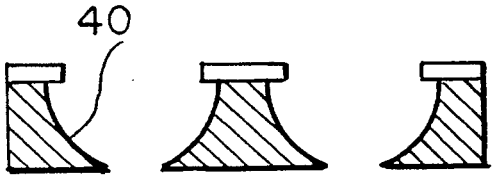

In step (c) an opening 36 is formed through the wafer 20 by an anisotropic wet etch. The opening 36 shown in the process flow diagram of FIG. 1 is the result of a potassium hydroxide (KOH) applied to the Si wafer 20 in the [100] orientation. The side 38 of the square opening 36 is aligned along the (111) plane so that there is minimum undercutting of the hard mask 22. The result is an aperture 36 having an enlarged opening 40 at the front face 28 and a relatively smaller opening 42 at the back face 29. The opening or aperture 36 through the wafer 20 has a shape of a truncated inverted pyramid as depicted in FIGS. 2A and 2B. Other openings and etch systems may be employed. For example, a circular opening 40 may be created with a Si etch such as HNA (hydrofluoric-nitric-acetic acid). The resulting geometry of such an etch is depicted in FIGS. 2C and 2D and highlights the undercutting of the hard mask resulting from an isotropic etch. In FIGS. 2C and 2D, the aperture or opening 40 has the shape of an inverted truncated hemisphere.

Regardless of the exact geometry of the aperture through the wafer, the remainder of the process is generally the same. After the aperture in the wafer 20 has been formed in step (c), the outer nitride layer 26 is removed from the front face 28 with a dry etch, as shown in step (d).

In step (e), the underlying oxide layers 24 are removed from the front face 28 and from the bottom opening 42 of the aperture 36 by an HF wet etch.

In step (f), the remaining nitride 26 is removed from the wafer 22 with hot (140°–160° C.) phosphoric acid ($H_3PO_4$) which is highly selective to both Si and $SiO_2$. The result is a dynode aperture preform 50 having a resulting isolation layer 52 and a through aperture 54 formed in the substrate 20. The isolation layer 52 is the portion of the outer isolation layer 24, referred to above, remaining after the various etch steps.

In step (g), a pair of dynode aperture preforms 50 are assembled with the front faces 28 in confronting relation and the apertures 54 aligned in registration, as shown. The dynode aperture preforms 50 are then bonded, top face to top face, and without an intermediate layer, to form one or more discrete dynode elements 56. These are later activated to become active dynodes as described hereinafter.

Bonding of the dynode aperture preforms 50 is generally completed by direct fusion bonding. The technique requires the surface of the components to be extremely flat, smooth and free of particles. The clean surfaces are brought into contact and are heated to a temperature in a range of about 600°–1000° C. for an interval of about one to about three hours. This results in complete bonding of the dynode aperture preforms 50 to form the discrete dynode elements 56. In addition to direct fusion bonding, field assisted bonding may also be employed.

In step (h), once the dynode aperture preforms 50 have been bonded to form the discrete dynode elements 56, a number of such discrete dynode elements are stacked together and bonded to produce a discrete dynode stack 60, e.g., five or more dynode elements. An input aperture 62, an output aperture 64 and an anode 66 may be added to complete the stacked structure, as shown in FIGS. 1 and 3–5. Respective input and output apertures 62 and 64 may each be an exemplary single dynode aperture preform 50, discussed above, which has been bonded to the stack 60.

Figure 4:
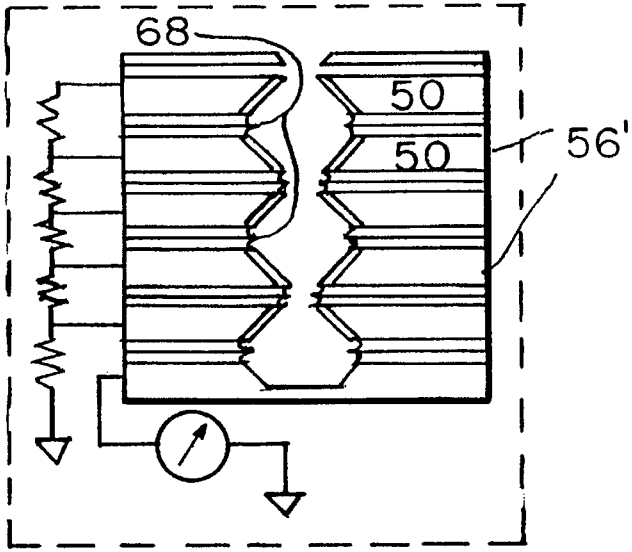
FIG. 4 is a side sectional elevation of a discrete dynode electron multiplier according to an embodiment of the invention employing an intermediate layer between aperture preforms.

It should be recognized that the dynode aperture preforms 50 may be directly bonded, top face to top face, with no intermediate layer, as shown, when forming discrete dynode elements 56'. Alternatively, the dynode aperture preforms 50 may be separated by an intermediate insulator layer, or a semiconductive layer 68, as shown in the embodiment of FIG. 4.

Anode 66 may be an integrated structure constructed by the same basic process as described above. The difference is apparent in only one step of the process, namely step (c). The KOH wet etch of the dynode aperture 36 is stopped before penetrating the back side of the wafer 22, thereby leaving a bottom surface 70 to collect the output electrons. The anode 66 may then be bonded to the output aperture 64 to form the integrated structure, as shown.

Figure 3:
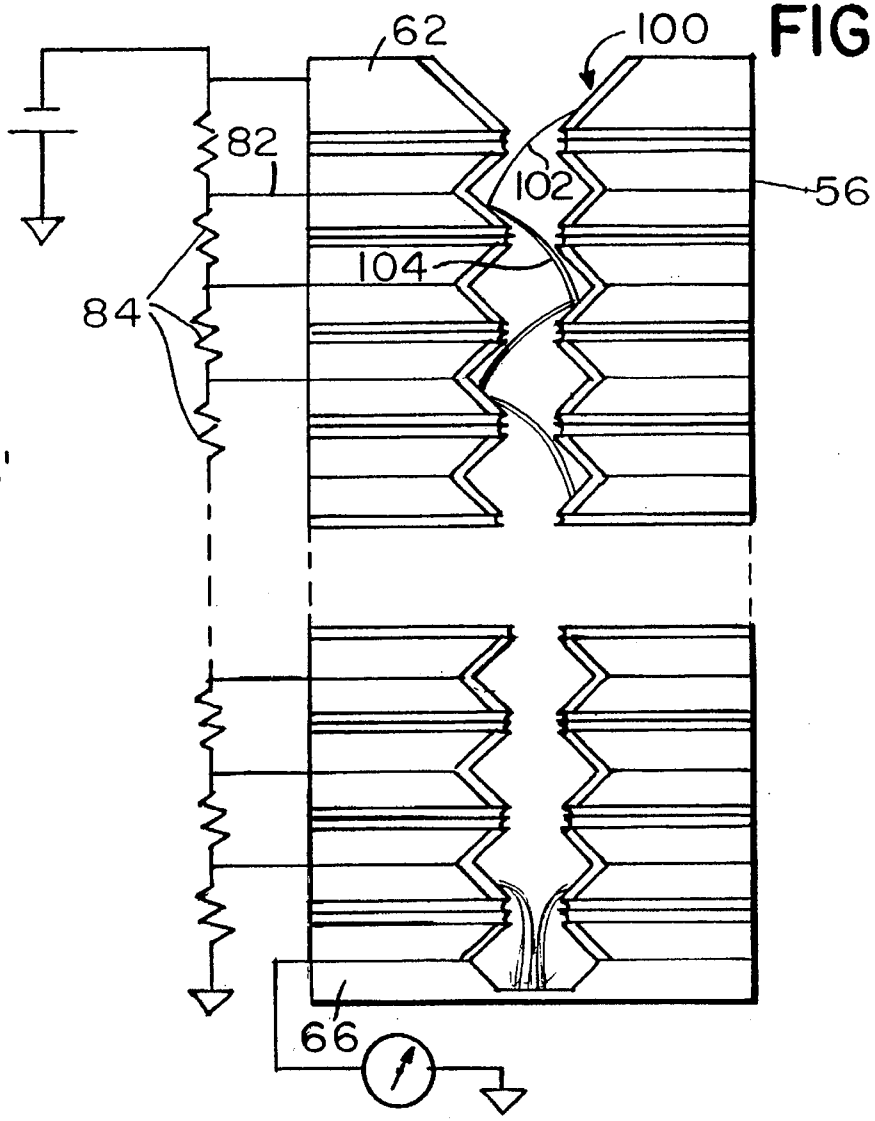
FIG. 3 is a side sectional elevation of a discrete dynode electron multiplier according to an embodiment of the invention.
Figure 3A:
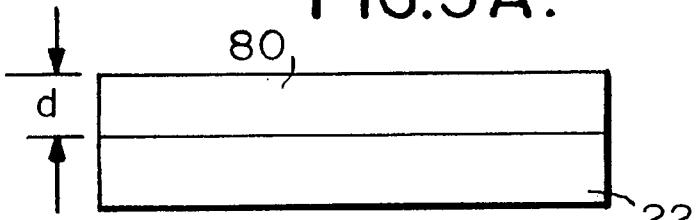
FIG. 3A is an enlarged fragmentary cross section of the emissive surface shown in FIG. 3.

To activate the tapered surfaces 38 of the discrete dynode elements 50, an electron emissive film 80, with good secondary electron yield properties is employed, step (h), FIG. 1 and FIG. 3A. Generally, the film 80 is deposited on the surfaces 38 by low pressure chemical vapor deposition (LPCVD) to a thickness of about 2 to about 20 nm. Suitable materials include $SiO_2$ or $Si_3N_4$ although $Al_2O_3$, AlN, C(diamond) or MgO may also serve as excellent candidates. For example, silicon nitride ($SiN_x$) or silicon oxynitride ($SiN_xO_y$) may be deposited with a combination of dichlorosilane ($SiCl_2H_2$), ammonia ($NH_3$) and nitrous oxide ($NO_2$) in the temperature range of about 700° to about 900° C. at a pressure of about 100 to about 300 mtorr. Direct thermal oxidation could be carried out at about 800° to about 1100° C. in dry $O_2$ at atmospheric pressure. Other methods for producing an electron emissive film 80 include atmospheric pressure chemical vapor deposition (APCVD) and surface modification by thermal oxidation or nitriding techniques.

A discrete dynode multiplier according to the invention may be biased in one of two ways, direct or indirect. The most conventional method of biasing these devices is the direct method. This is shown in FIG. 3 by applying leads 82 to the discrete dynode elements 56, the input aperture 62 and the anode 66 and maintaining a potential at each element by means of an external resistor network 84. The direct biasing technique is further exemplified in FIG. 4 wherein different voltages may be separately applied to each dynode aperture preform 50 forming the discrete dynode element 56'. As noted above, each dynode aperture preform 50 is separated from an adjacent preform by the insulating inner layer 68. A disadvantage of the direct biasing technique, illustrated in FIGS. 3 and 4, is an increasing in the manufacturing complexity and cost associated with the multiple electrical contacts and multiple resistors. Also, this technique makes miniaturizing of the device difficult.

Figure 5:
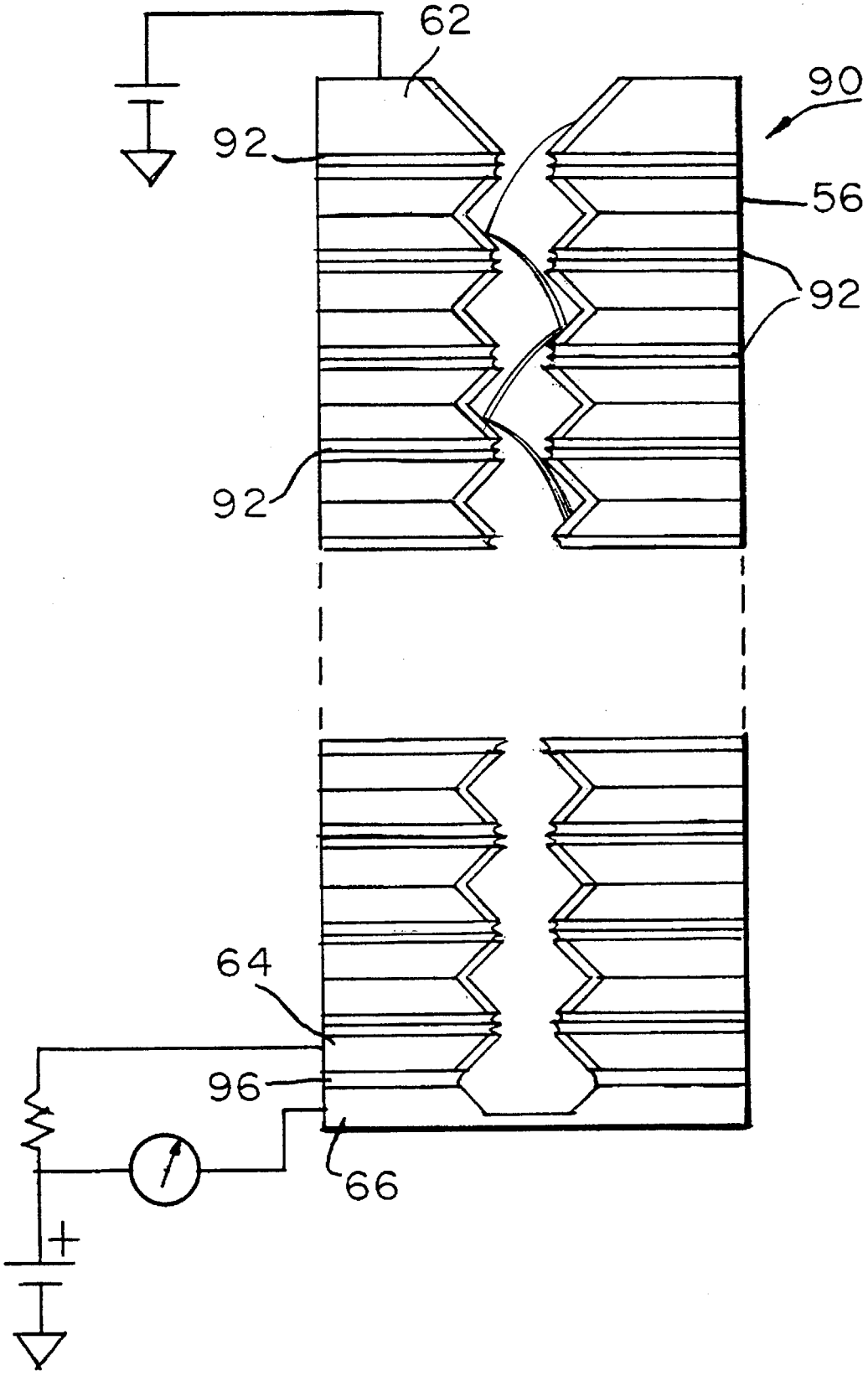
FIG. 5 is a side sectional view of a discrete dynode electron multiplier according to an embodiment of the invention employing a resistive layer between dynode elements.

The indirect method of biasing is illustrated in the embodiment of FIG. 5, in which a discrete dynode electron multiplier 90 employs an integrated resistor network. In this arrangement, a semi-insulating or resistive layer 92 of an appropriate resistivity is applied to the wafer 22 in step (a) depicted in FIG. 1. The film or layer 92 separating the discrete dynode elements 56 acts as a resistor to allow the discrete dynode elements to be biased with only a single electrical connection to the input aperture 62, the output aperture 64 and the anode 66 through the device 90, as shown. This allows for generally simplified manufacture and easier miniaturization of the device.

The biasing depicted in FIGS. 3 and 4 is configured for collecting positive charged particles, neutral particles, UV-rays and soft x-rays. This may be changed to a positive biased aperture, as depicted in FIG. 5, to collect negatively charged particles (i.e., ions) by floating the integrated anode 66 by means of an electrically insulating layer 96 to allow the anode 66 to collect output current. Floating of the anode 66 requires the insulating layer 96 to be deposited on the anode even if intermediate resistive biasing layers 92 are employed.

Figure 6:
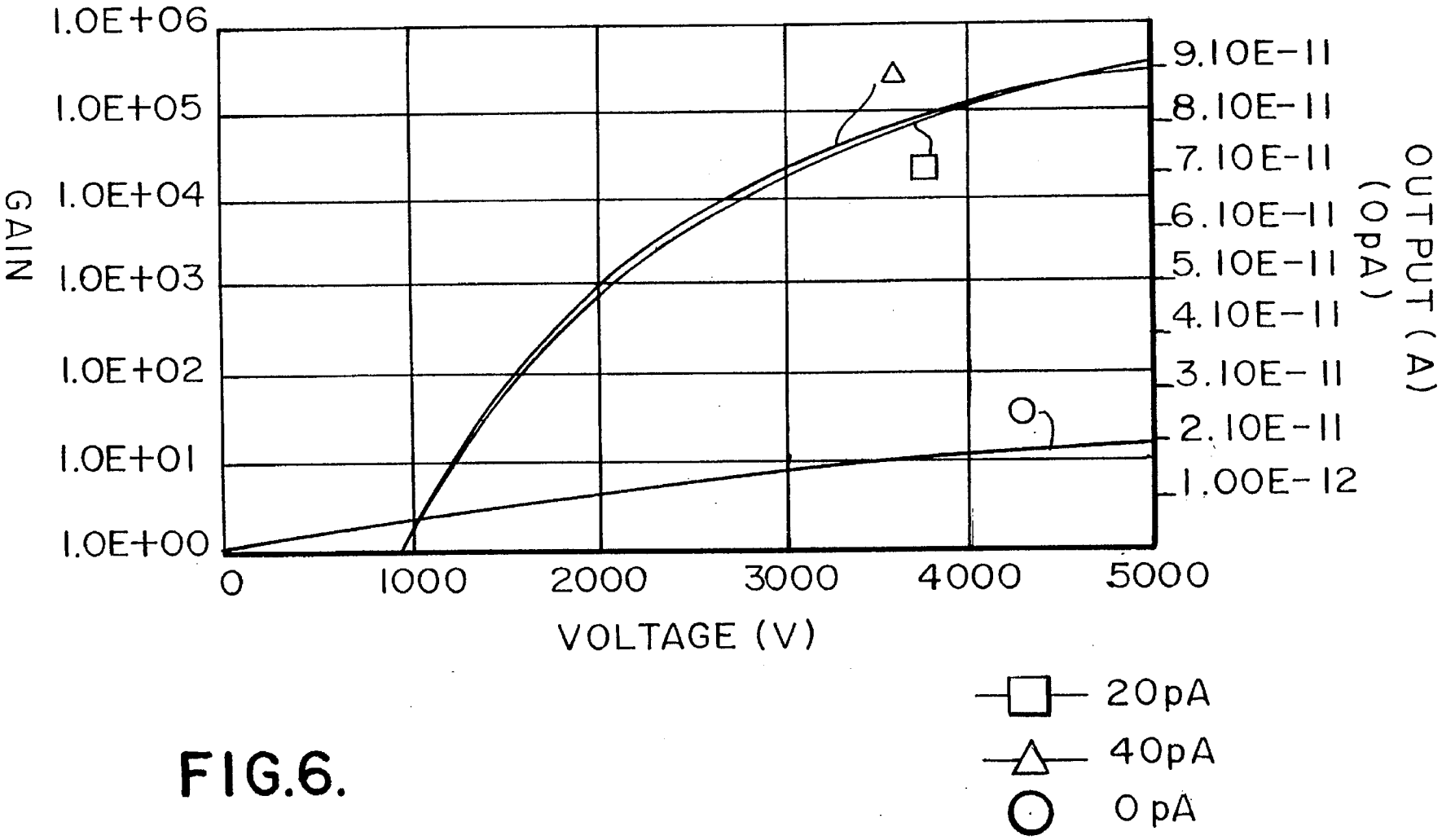
FIG. 6 is a plot of gain versus applied voltage data for an exemplary embodiment of the invention.

An exemplary device manufactured by the process depicted in FIG. 1, and biased as depicted in FIG. 4 has been constructed and tested. The wafers 22 are each 380 microns in thickness, with a front side opening to each dynode element of about 960 microns. The device is indirectly biased and employs 12 discrete dynode elements. A plot of the gain of the device versus applied voltage is shown in FIG. 6.

According to the invention, as illustrated in FIG. 3, an input particle, e.g., an energetic electron, an ion, a UV photon, a x-ray or the like 100 enters the input aperture 62 and produces a secondary emission 102 which strikes the discrete dynode element 56 immediately there below, as shown. Additional secondary electrons 104 are produced which thereafter cascade to the next lower level and on through the stack to the anode 66 as output electrons 106. An output current $I_o$ is thus produced which is indicative of the gain of the device. Any number of stages may be employed, although it is anticipated that about five to about twenty stages provide a useful range of gain. The exemplary embodiment producing the data illustrated in FIG. 6, employs 12 stages.

While there have been described what are at present considered to be the preferred embodiments of the present invention, it will be apparent to those skilled in the art that various changes and modifications may be made therein without departing from the invention, and it is intended in the appended claims to cover such changes and modifications as fall within the spirit and scope of the invention.

What is claimed is:

1. A method for manufacturing a discrete dynode electron multiplier comprising the steps of:

forming an etchable planar substrate having first and second sides and capable of carrying a current sufficient to replenish electrons;

forming an electrical isolation layer on the sides of the substrate;

forming a first mask layer overlying the isolation layer on the substrate;

forming a photoresist pattern mask layer having apertures therein on the first mask layer on the first side of the substrate;

transferring the pattern from the photoresist mask layer through the first mask layer and electrical isolation layer by anisotropically etching the first mask layer and the isolation layer through the apertures in the photoresist pattern mask layer to the first side of the substrate proximate said pattern mask layer to produce corresponding apertures in the first mask layer and isolation layer;

anisotropically or isotropically etching the substrate through the corresponding apertures to produce an aperture structure having surfaces transverse to the axis of the aperture through the substrate to the second side thereof and isotropically etching an aperture through the isolation layer to the first mask layer on the second side of the substrate;

removing the pattern mask, the first mask layer and the isolation layer adjacent to the pattern mask layer;

aligning and bonding a pair of substrates in confronting relationship on the side thereof remote from the apertured isolation layer to produce a discrete dynode element;

activating the anisotropically or isotropically etched surfaces of the dynode elements formed in the substrate; and aligning and stacking a plurality of discrete dynode elements.

2. The method of claim 1 further including the step of adjusting the resistance of the isolation layer to produce one of an insulator and a resistor.

3. The method of claim 1 further comprising the step of aligning and bonding five or more of dynode elements.

4. The method of claim 1 further comprising the step of aligning and bonding an apertured substrate on one side of the pair of substrates on the side thereof adjacent the apertured isolation layer for forming at least one of an input and an output aperture.

5. The method of claim 1 further comprising the step of forming an anode and bonding the anode to a side of said pair of substrates adjacent the isolation layer.

6. The method of claim 5 wherein the step of forming the anode comprises the steps of:

forming an etchable planar substrate having first and second sides and capable of carrying a current;

forming an electrical isolation layer on the sides of the substrate;

forming a first mask layer overlying the isolation layer on the substrate;

forming a pattern mask layer having apertures therein on the first mask layer on the first side of the substrate;

transferring the pattern from the photoresist mask through the hard mask in the isolation layer by anisotropically etching the first mask layer and the isolation layer through the aperture in the pattern mask layer to the first side of the substrate proximate the pattern mask layer to produce corresponding apertures in the first mask layer and the isolation layer;

anisotropically etching the substrate through the corresponding apertures to produce a tapered opening in the substrate in the form of a truncated pyramid having a surface portion opposite the aperture.

* * * * *